US005919098A

United States Patent [19]

Salmon

[11] Patent Number: 5,919,098

[45] Date of Patent: Jul. 6, 1999

[54] GOLF AID

[76] Inventor: Keith William Salmon, Trelawns, Tredragon Road, Mawgan Porth, Newquay, Cornwall, United Kingdom, TR8 4DQ

[21] Appl. No.: 09/029,987

[22] PCT Filed: Sep. 18, 1996

[86] PCT No.: PCT/GB96/02286

§ 371 Date: Mar. 12, 1998

§ 102(e) Date: Mar. 12, 1998

[87] PCT Pub. No.: WO97/10879

PCT Pub. Date: Mar. 27, 1997

[30] Foreign Application Priority Data

Sep. 19, 1995 [GB] United Kingdom ..... 9519121
Nov. 23, 1995 [GB] United Kingdom ..... 9524014

[51] Int. Cl.[6] ..... A63B 69/36

[52] U.S. Cl. ..... 473/220; 362/184; 362/191

[58] Field of Search ..... 473/220; 273/186.3; 362/72, 184, 191

[56] References Cited

U.S. PATENT DOCUMENTS 2,787,470 4/1957 Barrus .
3,106,403 10/1963 Kirkman .
3,820,795 6/1974 Taylor ..... 473/220
5,170,664 12/1992 Hirsh .
5,401,030 3/1995 Halliburton .
5,667,185 9/1997 Maglica ..... 362/72 X

FOREIGN PATENT DOCUMENTS 2110095 6/1983 United Kingdom ..... 273/186.3

*Primary Examiner*—George J. Marlo
*Attorney, Agent, or Firm*—Jones & Askew, LLP

[57] ABSTRACT

Illumination apparatus for attachment to a golf club and containing a light source which directs a light beam toward the eyes of the golfer. The apparatus includes a housing selectively attachable to the shaft of a golf club and having at least one light source. The light source may be mounted in a turret optionally retractable within a recess of the housing. The light source, which may be two in number, are settable in selected angular positions for proper adjustment of the light beam.

8 Claims, 2 Drawing Sheets

GOLF AID

This invention relates to a golf aid to improve a golfer's club swing during practice strokes. More particularly, the present invention relates to apparatus which can be releasably attached to a golf club and which aids golfers to effect the correct club swing when hitting a golf ball.

In the game of golf it is generally accepted that the three most important factors when striking the ball, in order to obtain the best results, are that the eyes should focus on the ball without the head being lifted, the return swing should be taken at the correct speed and should not be forced, and the path of the club head on both the back and return swings should be correct especially in the twelve inches or thereabouts behind the ball and in front of it on the follow-through part of the stroke. For most purposes, the path is at 90° to the direction in which the golfer faces in addressing the ball, any deviation from this path tending to impart spin to the ball resulting in a hook or slice shot. In particular, the greatest difficulty for most people seems to be the exercise of self control to keep the eyes on the ball until it has been hit; there is a strong tendency for the head to come up and for the eyes to follow the anticipated path of the ball even before impact with the club.

Many devices are known in the prior art which can be used during practice to help the golfer drive the golf ball straight, but the problem of eye and head control has not been effectively solved.

According to one aspect of the present invention, apparatus for improving a golfer's club swing comprises a housing releasably attachable to a golf club and containing a light source which in use directs a light beam towards the eyes of the golfer.

In use, in movement of the club during both the backswing and the return or down swing and with the golfer's eyes directed at the ball, the movement of the club head is displayed as a streak of light in the retained peripheral vision of the golfer and he can accordingly take steps in succeeding practice strokes to compensate for any apparent error s or inaccuracies in his swing which would result in the ball being hooked or sliced. The need to concentrate on the ball and to observe the streak in relation thereto assists in overcoming the tendency to raise the head too early.

Preferably, the apparatus is used in conjunction with indicia placed on the ground as a reference mark to indicate the intended track of the club during the swing. such indicia preferably are fluorescent or otherwise of high visibility, whereby they can readily be seen in the peripheral vision of the golfer. The ground-marking indicia may comprise a narrow strip of fluorescent, brightly colored or otherwise highly visible plastics material, for example plastics ribbon, mounted on a thin backing and placed on the ground in alignment with the in tended direction of the swing, although they may be merely tees placed in the ground at appropriate locations.

While the apparatus of the present invention is particularly intended for use in relation to the drive stroke, it can be equally effective for all the other golf strokes, particularly for the putting stroke. While being of particular use for the novice player, the apparatus may also help the experienced golfer to practice and achieve a deliberate hook or slice shot, by placing the indicia at appropriate angles to the usual 90° path.

Preferably, the inventive apparatus is attachable to the shaft of the golf club towards the head thereof, although it may be attached to the head itself. The housing is preferably aligned parallel with the longitudinal axis of the club shaft and is disposed above the club head for optimum visibility during at least the lower part of the swing. The angle of the light beam emitted by the light source is preferably adjustable so as to be focused upwards directly into the eyes of the golfer, in use.

The inventive apparatus includes means for releasable attachment to the golf club. Such means may comprise snap engagement-type fasteners but may equally well comprise straps and conventional fasteners such as buckles or touch-close fastener material, for example Velcro (trade mark). The housing may be profiled to receive a portion of the periphery of the shaft, thereby ensuring correct alignment of the housing with the shaft; the profiling may comprise a groove or channel which can receive the entire cross section of the shaft with snap-action engagement or may comprise a V-section groove to accommodate shafts of different diameters; the profiling may include resilient pads to enhance the grip between the shaft and the housing and to eliminate any looseness. Additionally or alternatively, further retaining means, especially such as to resist any tendency for the housing either to twist or to move downwards on the shaft under the forces generated by the down stroke, may be provided.

Advantageously, the housing contains a battery or other cell as the power supply for the light source, although the power supply may be carried separately by the golfer and electrically connected to the light source. The apparatus preferably has an on-off switch.

To further improve the golfer's swing, the apparatus may be provided with means which deactivate the light source when the swing is poor, for example in the event of a jerky swing or a poor backswing. Such means may comprise an inertia switch.

The light source may comprise at least one LED and preferably two LED's which may be static or pulsed. Preferably, pulsed LED's are used for improved visibility during bright ambient-lighting conditions. Where two or more LED's are provided they may be selectively activatable. At least one LED is preferably recessed within a sleeve member to provide shading over the light source, again to achieve greater visibility in high ambient-lighting conditions. The sleeve member may form a turret which is pivotably mounted in a recess in the housing for movement between a recessed or storage position and an angularly-extended use position. The other or another LED may be positioned separately from the first LED to create an additional streak of light to indicate for example a tendency to angle the club incorrectly on the down stroke.

The beam produced by the light source may be white or may be colored to improve visibility in bright conditions. Optionally more than one light source or colored filters are provided to change the colour of the light beam as desired.

Embodiments of the invention will now be described by way of example with reference to the accompanying drawings, in which.

Figure 1:
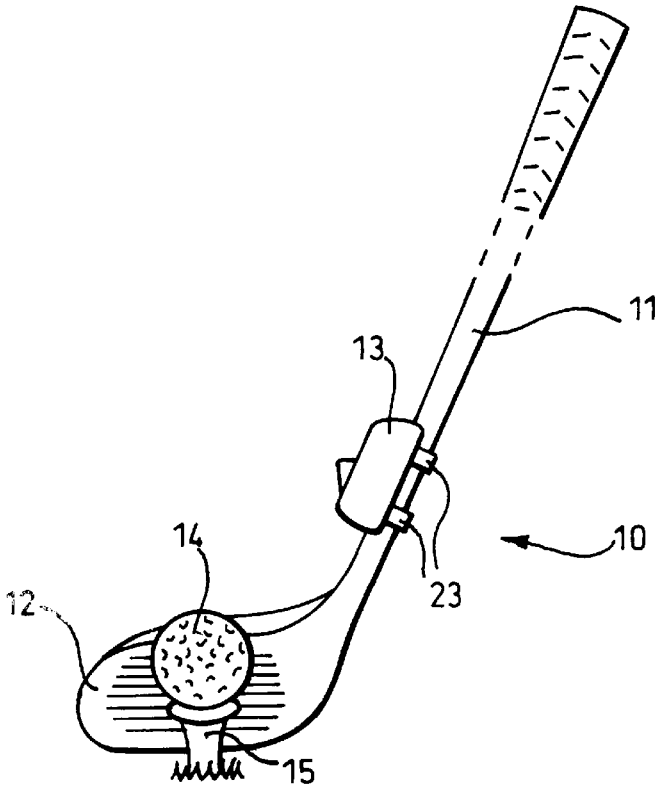
FIG. 1 shows one embodiment of the apparatus attached to a golf club, and a teed golf ball viewed towards the face of the club.
Figure 2:
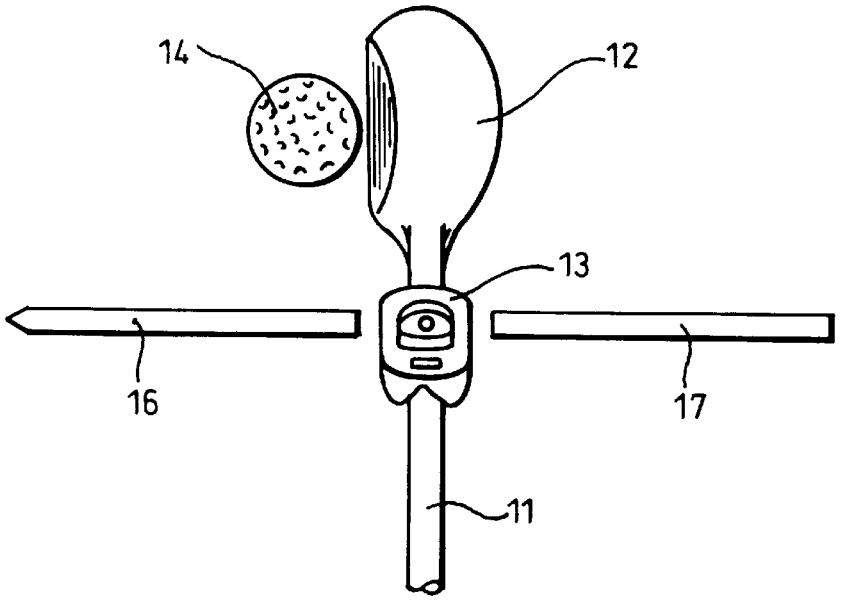
FIG. 2 shows a plan view of the apparatus of FIG. 1, together with strips of indicia material placed on the ground.

Referring to FIGS. 1 and 2 there is shown a golf club, generally indicated 10, consisting of a shaft 11 and a head 12. The golf swing improvement apparatus 13 is releasably attached to the shaft 11 above the head 12 and in a central position when viewed from above (FIG. 2). The club is shown in the address position in relation to a golf ball 14 on a tee 15. On each side of the golf ball 14 and in a straight line aligned with the intended direction of travel of the ball towards the hole (real or imaginary) are strips of colored fluorescent tape or ribbon 16, 17, which are weighted to ensure that they remain in position while the golf stroke is being practiced. Alternatively, the strip may be mounted on a backing material and secured to the ground with pegs, conveniently golf tee pegs.

Figure 3:
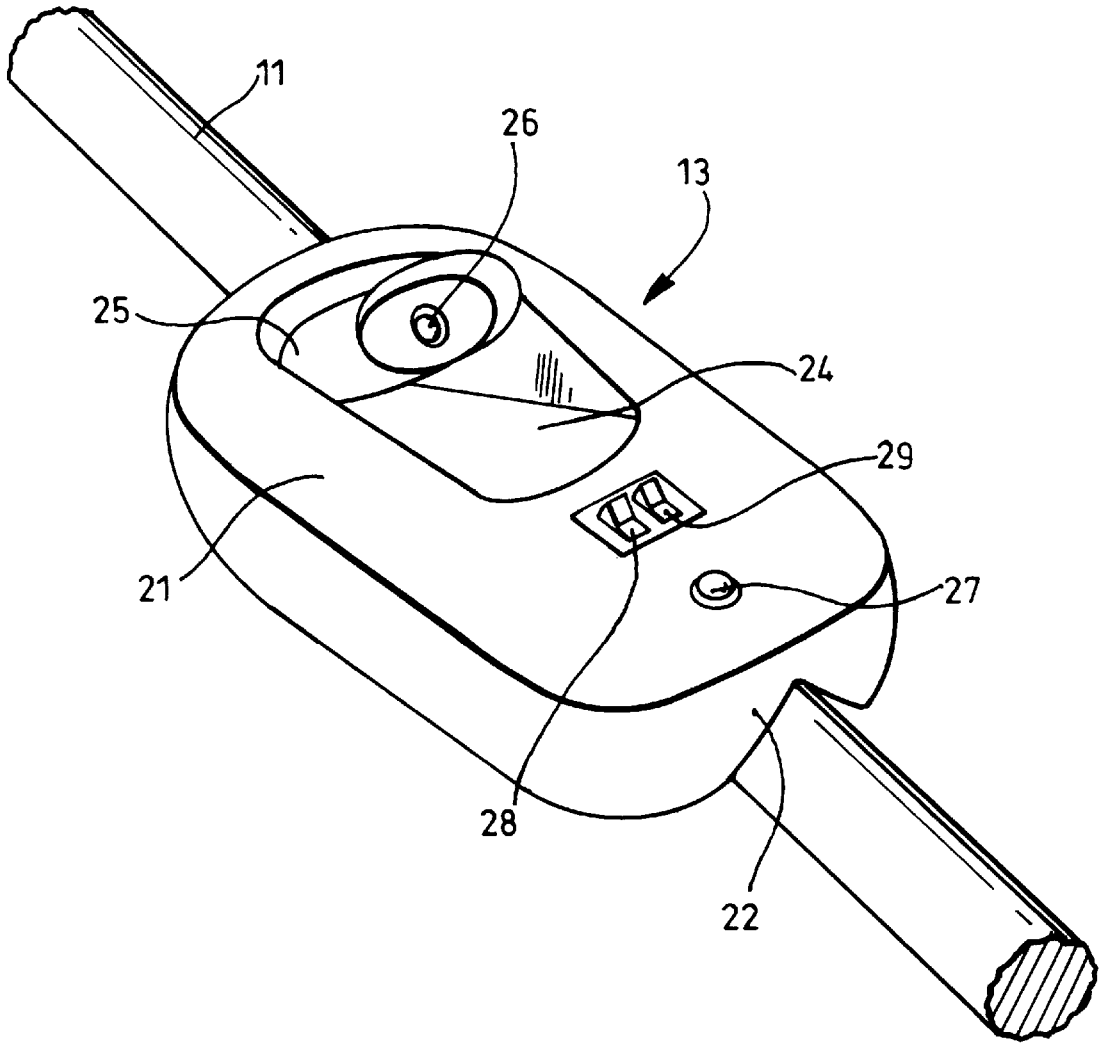
FIG. 3 shows a perspective view of the apparatus of FIGS. 1 and 2 in more detail.

Referring to FIG. 3, the apparatus 13 consists of a housing 21 the rear wall of which is formed as a V-section channel or groove 22 including longitudinally spaced-apart resilient pads (not shown) to fit the shaft 11 of the golf club. The rear of the housing is provided with flexible straps 23 (FIG. 1), which can be pulled tightly over the shaft to secure the housing thereon; the free end of the straps may be provided with teeth which adjustably engage the housing or may be secured by non-return buckles or the like. The front wall of the housing is formed with a recess 24 from which projects a turret 25 containing a recessed primary LED 26. A secondary LED 27 is mounted on the front wall, also on the center line, towards the upper end of the shaft. The LED's are operated by respective switches 28, 29. The turret 25 is optionally retractable within the recess 24 for storage. The housing contains miniature dry cell batteries contained within a separate compartment with a removable lid and the batteries are electrically connected to the LED's and switches by suitable circuitry. The LED's are individually angularly adjustable and are settable in selected angular positions, for example by being mounted in a barrel for longitudinal movement between an outer end position and a retracted position with bias towards the outer position, whereby the LED may be manually depressed against the bias, angularly adjusted and released to allow the bias to hold the LED at the correctly-adjusted angle in the outer end position.

In use, the LED 26 is switched on to provide a very bright, narrow beam of light through a suitable lens and the LED is angularly adjusted so that, with the golfer in the correct "set up" position for the club, the beam shines directly in the golfer's eye. The setting of this position ensures that the same "set up" position can be reliably reproduced after having moved the club, merely by manoeuvring the club until the beam once more shines in the golfer's eye. The second LED 27 is then switched on and the club head can be swung back so that the golfer can see in his retained peripheral vision a streak of light from each LED indicating the path of the swing. The path can be adjusted to maintain the streak from LED 26 in alignment with the ribbon 17. On the down-swing, the path is also visible from the approach to impact with the ball through to the first part of the follow-through, the golfer's head being held still all the while and the eyes remaining fixed on the ball. The streak from the second LED 27 will be seen to be forward of the streak from LED 26 if the golfer's hands are in front of the club head, resulting in an impact angle between the club face and the ball which would tend to drive the ball towards the ground rather than on a lofting trajectory.

The inventive apparatus is used not only to enable the correct address position to be consistently achieved and the backswing and downswings to be improved, but also to improve the speed of the swing. Thus, the eye will not have time to retain the vision or image of the streak of light if the club is moved too quickly. Therefore, to obtain the benefit of the invention, the swing speed and rhythm of the stroke must be correct.

Optionally, the circuitry includes an interrupt switch to turn off the LED's in the event of a jerky or otherwise incorrect backswing. Also, the LED's may be pulsed to improve visibility and the length and frequency of the pulses may be set to achieve the optimum apparent or most continuous brightness at the correct speed of the down-swing.

I claim:

1. Apparatus for improving a golfer's club swing, comprising;

a housing releasably attachable to a golf club having a shaft;

the housing being profiled on one side to receive a portion of the periphery of the shaft, thereby ensuring a predetermined alignment of the housing with the shaft;

the housing containing a light source positioned an a side of the housing opposite the one side and operative to direct a light beam toward the eyes of the golfer; and means permitting selective angular adjustment of the light source with respect to the housing so that the path of the light beam is adjustable to be aimed upwardly directly into the eyes of the golfer without adjusting the position of the housing on the golf club, so that the golfer can see in retained peripheral vision a streak of light from the light beam indicating the path of the swing.

2. Apparatus according to claim 1, in which the profiling comprises a groove or channel (22) which is V-shaped and the housing includes releasable retaining straps which in use pass over the golf club shaft to engage the housing with the shaft.

3. Apparatus according to claim 1, in which the profiling comprises a groove or channel which can receive the entire cross section of the shaft.

4. Apparatus according to claim 3, in which the groove or channel is adapted for snap-action engagement with the shaft.

5. Apparatus according to claim 1, in which the light source (26) comprises at least one LED operative to produce pulsed illumination for improved visibility.

6. Apparatus according to claim 1, in which the light source is shaded or shrouded to achieve greater visibility in high ambient-lighting conditions.

7. Apparatus according to claim 1, in which the light source is mounted in a turret pivotably mounted in a recess in the housing for movement between a recessed position and an angularly-extended use position relative to the housing, and the means permits said angular adjustment of the light in the use position.

8. Apparatus according to claim 1, including a secondary light source positioned on the housing in spaced-apart relation to the first-mentioned light source to direct a second beam of light upwardly into the eyes of the golfer so that the golfer can see separate streaks of light from both light beams to produce an indication of incorrect club angle.

* * * * *